US009562532B2

(12) United States Patent
Geremia

(10) Patent No.: US 9,562,532 B2
(45) Date of Patent: Feb. 7, 2017

(54) PROGRESSIVE VORTEX PUMP

(71) Applicant: HIGRA INDUSTRIAL LTDA, Sao Leopoldo (BR)

(72) Inventor: Silvino Geremia, Sao Leopoldo (BR)

(73) Assignee: HIGRA INDUSTRIAL LTDA, São Leopoldo (BR)

( * ) Notice: Subject to any disclaimer, the term of this patent is extended or adjusted under 35 U.S.C. 154(b) by 469 days.

(21) Appl. No.: 14/278,630

(22) Filed: May 15, 2014

(65) Prior Publication Data

US 2015/0330392 A1 Nov. 19, 2015

(51) Int. Cl.

| | |
|---|---|
| ***F04D 5/00*** | (2006.01) |
| ***F04D 13/10*** | (2006.01) |
| ***F04D 29/42*** | (2006.01) |

(52) U.S. Cl.

CPC ..... *F04D 5/006* (2013.01); *F04D 13/10* (2013.01); *F04D 29/4273* (2013.01); *F04D 29/4293* (2013.01)

(58) Field of Classification Search

CPC ..... F04D 5/006; F04D 13/10; F04D 29/4273; F04D 29/4293

USPC ..... 415/199.1; 417/171

See application file for complete search history.

(56) References Cited

U.S. PATENT DOCUMENTS

| | | | | |
|---|---|---|---|---|
| 2,842,062 | A * | 7/1958 | Wright | F04D 5/002 29/27 B |
| 3,592,566 | A * | 7/1971 | Beardslee | A47L 5/22 15/347 |
| 3,969,039 | A * | 7/1976 | Shoulders | F04D 19/046 250/441.11 |
| 5,074,747 | A * | 12/1991 | Ikegami | F04D 17/168 415/55.1 |
| 6,893,206 | B2 * | 5/2005 | Talaski | F04D 5/006 415/55.6 |
| 2008/0050249 | A1 | 2/2008 | Geremia | |

FOREIGN PATENT DOCUMENTS

BR MU8802106 U2 6/2011

* cited by examiner

*Primary Examiner* — Hoang Nguyen
(74) *Attorney, Agent, or Firm* — Carter, DeLuca, Farrell & Schmidt, LLP

(57) ABSTRACT

A progressive vortex pump having a pump assembly including an inlet valve in contact with a fluid and an outlet valve in contact with a pump pipe, the pump assembly is driven by a shaft connected to a motor assembly and includes a pump body with a variety of pump stages having a stator attached to the pump body, a diffuser attached to the front and rear of the stator, and a rotor coupled to the shaft inside the stator. Each pump stage includes at least two inlet stages in contact with a respective circular channel in contact with a respective outlet stage, the inlet and outlet stages are evenly distributed along the internal perimeter of the stator, and the pump stages are arranged such that each outlet stage of a front pump stage is connected to a respective inlet stage of a rear pump stage.

1 Claim, 10 Drawing Sheets

PROGRESSIVE VORTEX PUMP

The present invention is an improvement to a progressive vortex pump used in pumping systems n oil wells, for example.

A conventional vortex pump was described in P10603597-3. This progressive vortex pump consists of a pump assembly equipped with an inlet valve in contact with a fluid to be pumped and an outlet valve in contact with a pump pipe; the pump assembly is driven by a shaft attached to a motor assembly., When the progressive vortex pump is installed in a well such as an oil well, for example, the pump assembly is positioned inside a well casing, with the upper end situated at the surface of the well and the lower end in contact with the fluid to be pumped. Similarly, the pump tubing runs inside the well casing pipe to the well surface.

In the case of P10603597-3, the shaft of the progressive vortex pump runs from the pump assembly through the pump tubing up to the motor assembly positioned at the surface of the well. MU8802106-8 describes a progressive vortex pump where the shaft runs from the pump assembly to the motor assembly consisting of a submersed electric motor positioned underneath the pump assembly.

In both the progressive vortex pump with the surface motor assembly and that with the submersed motor assembly, the pump assembly is also equipped with a pipe body inside of which are several pump stages. Each pump stage is formed by a stator attached to the pump body, a diffuser attached to the front of the stator, a second diffuser on the rear of the stator and a rotor coupled to the shaft and positioned inside the stator.

Each pump stage consists of an inlet stage connected to a circular channel which, in turn, is connected to an outlet stage. The rotor blades are positioned inside the circular channel. The pump stages are arranged so that the outlet stage of a front pump stage is connected to the inlet stage of a rear pump stage.

Under operating conditions, the rotation of the rotor causes fluid to enter the pump stage through the stage inlet; the fluid then passes along the circular channel, exits the pump stage through the outlet stage and moves on to the next pump stage. Thus, the pressure of the fluid increases between the inlet stage and outlet stage.

A conventional progressive vortex pump presents a problem of excessive shear stress acting on the shaft, which may cause shaft failure due to shear. More specifically the difference in pressure between the inlet and outlet stages results in shear stress that acts on the shaft in each pump stage.

The objective of the present invention is to improve a progressive vortex pump so as to eliminate the problem of excessive shear stress on the shaft.

To that end, we propose a progressive vortex pump in which each pump stage consists of at least two inlet stages, with each inlet stage connected to a respective circular channel and each circular channel connected to a respective outlet stage; the inlet stages are evenly distributed along the internal perimeter of the stator and the outlet stages are evenly distributed along the internal perimeter of the stator, with the pump stages arranged such that each outlet stage of a front pump stage is connected to a respective inlet stage of a rear pump stage.

Beneficially, the fact that the inlet and outlet stages are evenly distributed along the internal perimeter of the stator results in zero shear stress on the shaft in each pump stage.

The invention can be better understood through the detailed description provided below, which is best interpreted using the following figures.

Figure 1:
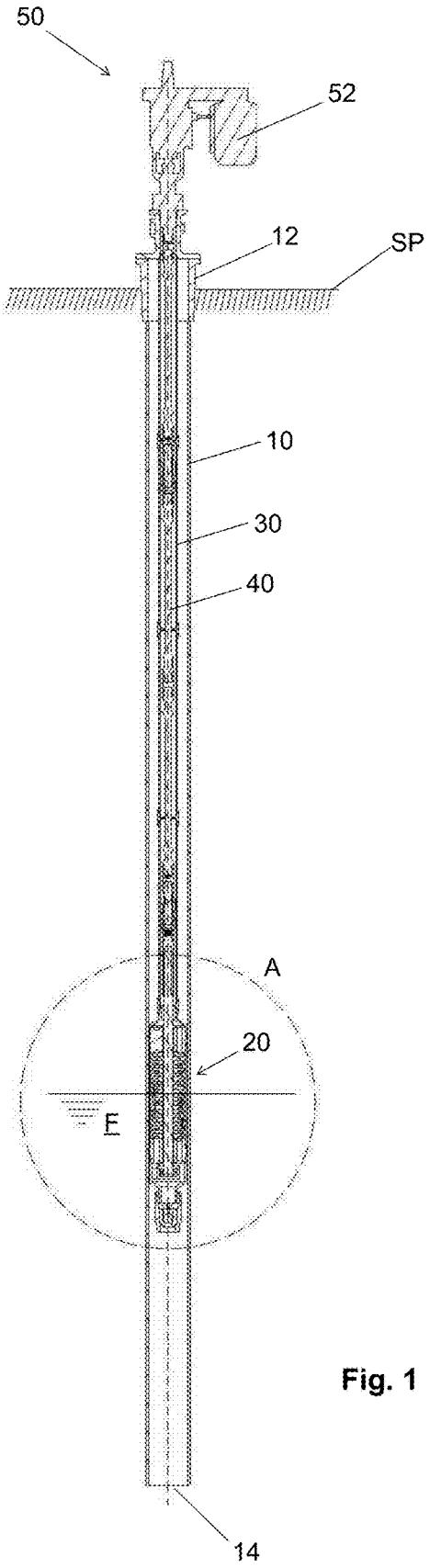
FIG. 1 shows a longitudinal section of a progressive vortex pump according to the invention, installed in a well, with a surface motor assembly (50).

The present invention proposes a progressive vortex pump consisting of a pump assembly (20) containing an inlet valve (21) in contact with a fluid (F) to be pumped and an outlet valve (22) in contact with a pump pipe (30); the pump assembly (20) is driven by a shaft (40) associated with a motor assembly (50) and is also equipped with a pump body (23) inside which is a variety of pump stages (24); each pump stage (24) consists of a stator (240) attached to the pump body (23), a diffuser (250) attached to the front of the stator (240), another diffuser (250) attached to the rear of the stator (240), and a rotor (250) coupled to the shaft (40) inside the stator (240). In accordance with the invention, each pump stage (24) comprises at least two inlet stages (E), each inlet stage (E) is in contact with a respective circular channel (C), and each circular channel (C) is in contact with a respective outlet stage (S). the inlet stages (E) are evenly distributed along the internal perimeter of the stator (240), the outlet stages (S) are distributed evenly along the internal perimeter of the stator (240) and the pump stages (24) are arranged such that each outlet stage (S) of a front pump stage (24) is connected to a respective inlet stage (E) of a rear pump stage (24). The stator (240) is ring-shaped and its external surface (241) remains in contact with the internal surface of the pump body (23). The interior surface (242) of the stator (240) contains at least two locking protrusions (243) with straight front and rear surfaces (243*a*), a circular interior surface (243*b*) and axial length shorter than the axial length of the stator (240); the locking protrusions (243) are evenly distributed along the internal perimeter of the stator (240), at least two portions containing no material, configuring at least two stator inlets (244), each of which is located on either side of the respective locking protrusion (243); at least two passage protrusion (246) with straight front and rear surfaces (246*a*), axial length equal to the axial length of the locking protrusion (243) and internal surface (246*b*) in the shape of a curved double ramp with converging apexes (246*c*); each passage protrusion (246) is located next to the respective stator inlet (244) and at least two portions containing no material, configuring two stator outlets (245), where each stator outlet (245) is located next to the respective passage protrusion (246) and the length of the protrusion passage arch (246) is substantially longer than the length of the locking protrusion arch (243). In other words, the passage protrusions (246) extend over most of the internal perimeter of the stator (240), with one end of each passage protrusion (246) interrupted by the respective stator inlet (244) and the other end by the respective stator outlet (245), where the stator inlet (244) and outlet (245) are separated by the respective locking protrusion (243). The diffuser (250) is disc-shaped with a central opening (251) for the shaft (40) and containing at least two axial passages (252), each of which is defined by a lack of material in a region of the diffuser's border (250). The axial passages (252) are distributed evenly along the external perimeter of the diffuser (250), which contains at least two front recesses (253*a*) on its front surface (253), where each front recess (253*a*) extends in an arch from the respective axial passage (252) until the respective rear portion (253*b*) and the diffuser (250) contains at least two rear recesses (254*a*) on its rear surface (253); each rear recess (254*a*) extends in an arch from the respective axial passage (252) until a respective rear portion with no recess (254*b*), next to an axial passage (252) and offset in relation to a rear non-recessed portion (254*b*) neighboring this same axial passage.

The rotor (260) is disc-shaped with a central opening (261) enabling it to be coupled to the shaft (40); the rim (262) of the rotor (260) is shaped like a curved double ramp with converging apexes (262*a*), and is equipped with several blades (263); the diameter of the rotor (260) measured up to the blades (263) is larger than the diameter of the rotor (260) measured up to the apex.

The diffuser's (250) attachment to the front of the stator (240) is configured by the positioning of the rear surface of the diffuser (250) against the front surface of the locking protrusions (243) and the front surface of the passage protrusions (246), with each non-recessed rear portion aligned with a respective locking protrusion (243). The diffuser's (250) attachment to the rear of the stator (240) is configured by the positioning of the front surface of the diffuser (253) against the rear surface (243*a*) of the locking protrusions (243) and the rear surface of the passage protrusions (246), with each non-recessed front portion aligned with a respective locking protrusion (243).

Figure 4:
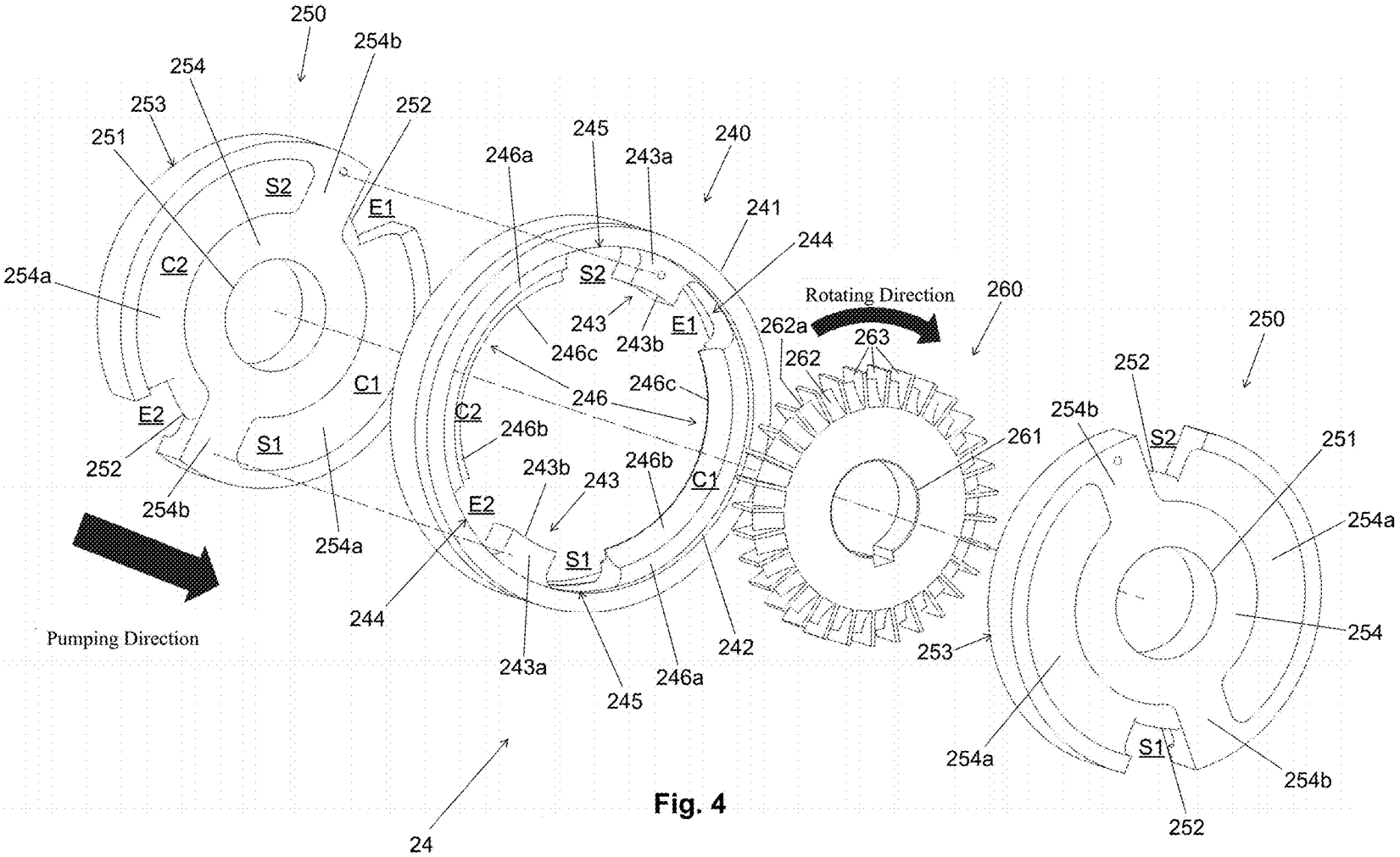
FIG. 4 is an exploded view of a progressive vortex pump (24), configured according to the first incorporation of the invention.
Figure 5:
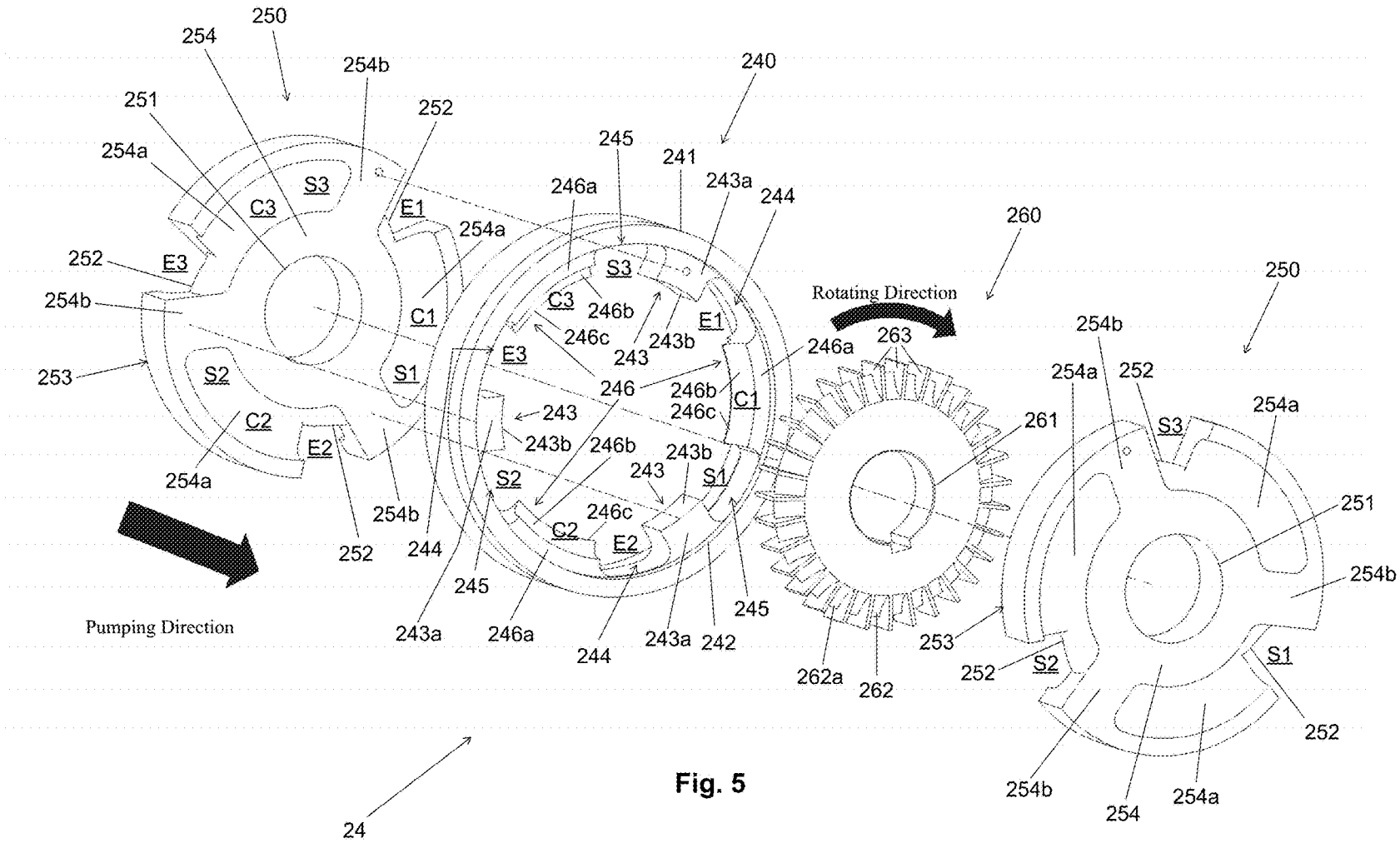
FIG. 5 is an exploded view of a progressive vortex pump (24), configured according to the second incorporation of the invention.

A pump stage (24), configured according to the first incorporation of the invention, which can be better visualized in FIG. 4, consists of two inlet stages (E1, E2). Each inlet stage (E1, E2) is connected to a respective circular channel (C1, C2) and each circular channel (C1, C2) is connected to a respective outlet stage (S1, S2). The inlet stages (E1, E2) are evenly distributed along the internal perimeter of the stator (240) and the outlet stages (E) are evenly distributed along the internal perimeter of the stator (240).

Figure 7:
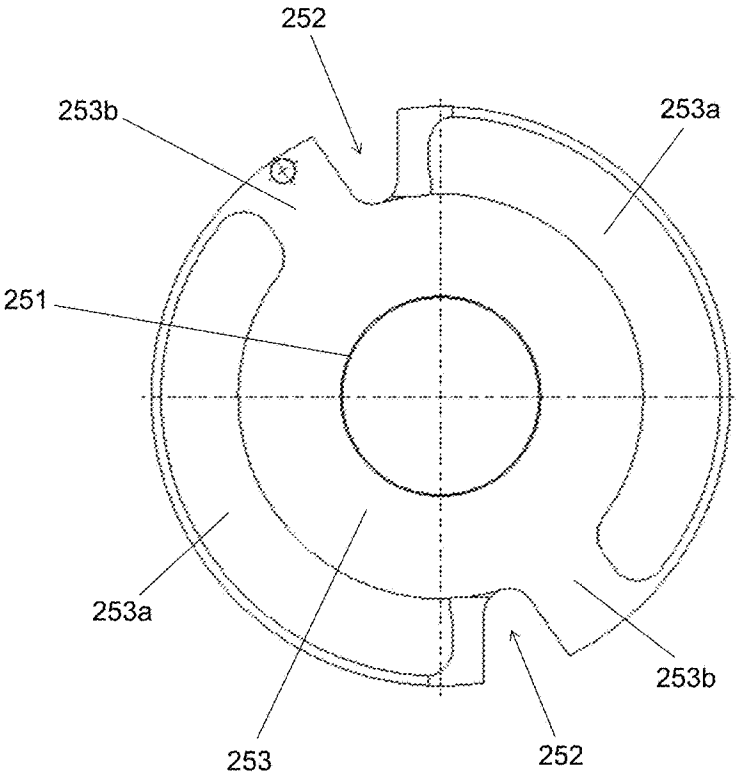
FIG. 7 shows a plan view of a diffuser (250), in accordance with the first incorporation of the invention, emphasizing its front surface.
Figure 6:
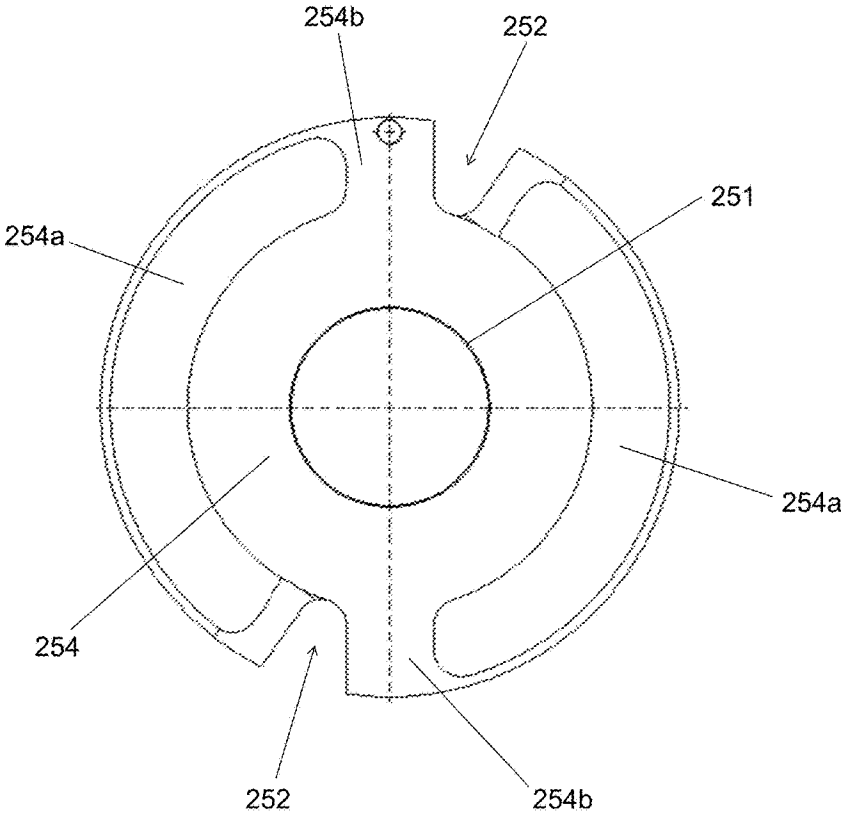
FIG. 6 shows a plan view of a diffuser (250), in accordance with the first incorporation of the invention, emphasizing its rear surface.

In this case, the internal surface (242) of the stator (240) contains two locking protrusions (243), evenly distributed along the internal perimeter of the stator (240), two stator inlets (244), each of which is located on either side of the respective locking protrusion (243); two passage protrusions (246), each located next to the respective stator inlet (244), and two stator outlets (245) situated next to the respective passage protrusion (246). As shown in FIGS. 6 and 7, the diffuser (250) attached to the front of the stator (240) has two axial passages (252), which are distributed evenly along the external perimeter of the diffuser (250), two front recesses (253*a*) located on its front surface, each extending in an arch from the respective axial passage (252) to the respective non-recessed rear portion (253*b*) and two rear recesses (254*a*) situated on its rear surface extending in an arch from the respective axial passage (252) until a respective non-recessed rear portion (254*b*). As shown in FIGS. 6 and 7, another diffuser (250) attached to the rear of the stator (240) has two axial passages (252), which are distributed evenly along the external perimeter of the diffuser (250); two front recesses (253*a*) on its front surface (253), each extending in an arch from the respective axial passage (252) to the respective non-recessed rear portion (253*b*) and two rear recesses (254*a*) situated on its rear surface (254), each extending in an arch from the respective axial passage (252) to a respective non-recessed rear portion (254*b*).

The first inlet stage (E1) of a pump stage (24) configured according to the first incorporation of the invention, is formed by the alignment of an axial passage (252) of the diffuser (250) attached to the front of the stator (240) with a respective stator inlet (244) and the respective end of front recess (253*a*) neighboring a non-recessed front portion (253*b*) of the other diffuser (250) attached to the rear of the stator. The first circular channel (C1) connected to the first inlet stage (E1) is formed by the alignment of a respective rear recess (254*a*) of the diffuser (250) attached to the front of the stator (240) with a respective passage protrusion (246) of the stator with the rim (262) of the stator (260) and the respective front recess (253*a*) of the other diffuser (250) attached to the rear of the stator (240). The first outlet stage (S1) connected to the first circular channel (C1) is formed by the alignment of the respective rear recessed end (254*a*) neighboring a non-recessed rear portion (254*b*) of the diffuser (250) attached to the front of the stator (240), with a respective axial passage (252) of the diffuser (250) attached to the rear of the stator (240). The second inlet stage (E2) of a pump stage (24), configured according to the first incorporation of the invention, is formed by the alignment of a second axial passage (252) of the diffuser (250) attached to the front of the stator (240) with the respective stator inlet (244) and the respective front recess end (253*a*) neighboring a non-recessed front portion (253*b*) of the other diffuser (250) attached to the rear of the stator. The second curricular channel (C2) connected to a second inlet stage (E2) is formed by the alignment of a respective rear recess (254*a*) of the diffuser attached to the front of the stator (240) with a respective passage protrusion (246) of the stator (240) with the rim (262) of the stator (260) and a respective front recess (253*a*) of the other diffuser (250) attached to the rear of the stator (240). The second outlet stage (S2) connected to the second circular channel (C2) is formed by the alignment of the respective rear recessed end (254*a*) neighboring a non-recessed rear portion (254*b*) of the diffuser (250) attached to the front of the stator (240), with a respective stator outlet (245) and with a respective axial passage (252) of the diffuser (250) attached to the rear of the stator (240).

A pump stage (24), configured according to the first incorporation of the invention, which can be better visualized in FIG. 4, consists of three inlet stages (E1, E2, E3), each (E1, E2, E3) connected to a respective circular channel (C1, C2, C3), each of which (C1, C2, C3) is connected to a respective outlet stage (S1, S2, S3); the inlet stages (E1, E2, E3) are evenly distributed along the internal perimeter of the stator (240) and the outlet stages (S1, S2, S3) are evenly distributed along the internal perimeter of the stator (240).

In this case, the internal surface (242) of the stator (240) contains three locking protrusions (243), evenly distributed along the internal perimeter of the stator (240), three stator inlets (244), each of which is located on either side of the respective locking protrusion (243); three passage protrusions (246), each located next to the respective stator inlet (244),; and three stator outlets (245) situated next to the respective passage protrusion (246). One diffuser (250) attached to the front of the stator (240) has three axial passages (252), which are distributed evenly along the external perimeter of the diffuser (250), three front recesses (253*a*) located on its front surface, each extending in an arch from the respective axial passage (252) to the respective non-recessed front portion (253*b*) and three rear recesses (254*a*) situated on its rear surface (254), each extending in an arch from the respective axial passage (252) to a respective non-recessed rear portion (254*b*). The other diffuser (250) attached to the rear of the stator (240) has three axial passages (252), which are distributed evenly along the external perimeter of the diffuser (250), three front recesses (253*a*) located on its front surface, each extending in an arch from the respective axial passage (252) to the respective non-recessed front portion (253*b*) and three rear recesses (254*a*) situated on its rear surface (254), each extending in an arch from the respective axial passage (252) to a respective non-recessed rear portion (254*b*).

The first inlet stage (E1) of a pump stage (24) configured according to the second incorporation of the invention attached to the front of the stator (240) with the respective stator inlet (244) and the respective front recess end (253*a*) neighboring a non-recessed front portion (253*b*) of the other diffuser (250) attached to the rear of the stator. The first circular channel (C1) connected to the first inlet stage (E1) is formed by the alignment of a respective rear recess (254*a*) of the diffuser (250), attached to the front of the stator (240) with a respective passage protrusion (246) of the stator (240) with the rim (262) of the stator (260) and a respective front recess (253*a*) of the other diffuser (250) attached to the rear of the stator (240). The first outlet stage (S1) connected to the first circular channel (C1) is formed by the alignment of the respective rear recessed end (254*a*) neighboring a non-recessed rear portion (254*b*) of the diffuser (250) attached to the front of the stator (240), with a respective stator outlet (245) and a respective axial passage (252) of the diffuser (250) attached to the rear of the stator (240).

The second inlet stage (E2) of a pump stage (24) configured according to the second incorporation of the invention is formed by the alignment of a second axial passage (252) of the diffuser (250) attached to the front of the stator (240) with the respective stator inlet (244) and the respective front recess end (253*a*) neighboring a non-recessed front portion (253*b*) of the other diffuser (250) attached to the rear of the stator. The second curricular channel (C2) connected to a second inlet stage (E2) is formed by the alignment of a respective rear recess (254*a*) of the diffuser attached to the front of the stator (240) with a respective passage protrusion (246) of the stator (240), with the rim (262) of the stator (260) and a respective front recess (253*a*) of the other diffuser (250) attached to the rear of the stator (240). The second outlet stage (S2) connected to the second circular channel (C2) is formed by the alignment of the respective rear recessed end (254*a*) neighboring a non-recessed rear portion (254*b*) of the diffuser (250) attached to the front of the stator (240), with a respective stator outlet (245) and a respective axial passage (252) of the diffuser (250) attached to the rear of the stator (240).

The third inlet stage (E3) of a pump stage (24) configured according to the second incorporation of the invention I formed by the alignment of a third axial passage (252) of the diffuser (250) attached to the front of the stator (240) with a respective stator inlet (244) and with the respective end of the front recess (253*a*) neighboring a non-recessed front portion (253*b*) of the other diffuser (250) attached to the rear of the stator (240). The third curricular channel (C3) connected to a third inlet stage (E3) is formed by the alignment of a respective rear recess (254*a*) of the diffuser (250) attached to the front of the stator (240) with a respective passage protrusion (246) of the stator (240), with the rim (262) of the stator (260) and a respective front recess (253*a*) of the other diffuser (250) attached to the rear of the stator (240). The third outlet stage (S3) connected to the third circular channel (C3) is formed by the alignment of the respective rear recessed end (254*a*) neighboring a non-recessed rear portion (254*b*) of the diffuser (250) attached to the front of the stator (240), with a respective stator outlet (245) and a respective axial passage (252) of the diffuser (250) attached to the rear of the stator (240).

Figure 8:
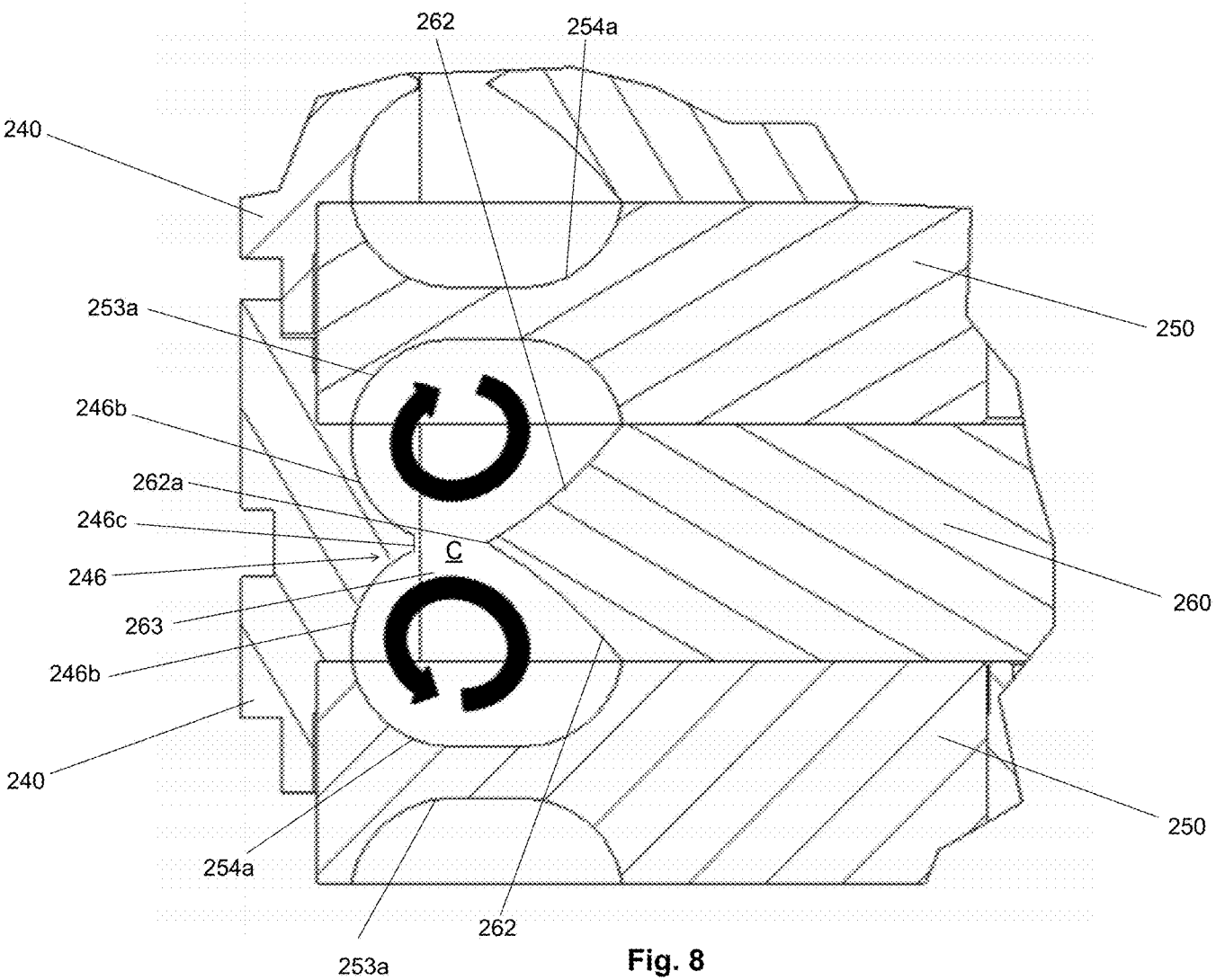
FIG. 8 shows an enlarged view of region "B" indicated in FIG. 2.

As shown in FIG. 8, one circular channel is delimited by the internal surface (246*b*) of the passage protrusion (246) of the stator (240), by the front recess (253*a*) of the diffuser (250) attached to the rear of the stator (240), by the rim (262) of the stator and the rear recess (254*a*) of the diffuser attached to the front of the stator (240). The rotor blades (263) are positioned inside the circular channel (C). The apex (246*c*) of the passage protrusion (246*c*) is aligned with the apex (262*a*) of the rim (262) of the rotor (260), dividing the circular channel (C) into two regions.

Under operating conditions, the rotation of the rotor (260) causes the fluid (F) to enter the pump stage (24) through the stage inlets (E1, E2, E3); the fluid then passes along the circular channel (C1, C2, C3), exits the pump stage (24) through the respective outlet stage (S1, S2, S3) and moves on to the next pump stage (24). The fluid (F) moves in a vortex in each of the two regions of the circular channels (C) as it passes through the circular channel (C), as indicated by the arrows in FIG. 8.

The pressure of the fluid (F) increases gradually from the inlet stage (E1, E2, E3) to the respective outlet stage (S1, S2, S3). Beneficially, the fact that the inlet and outlet stages are evenly distributed along the internal perimeter of the stator results in zero shear stress on the shaft (40) in each pump stage (24).

Figure 9:
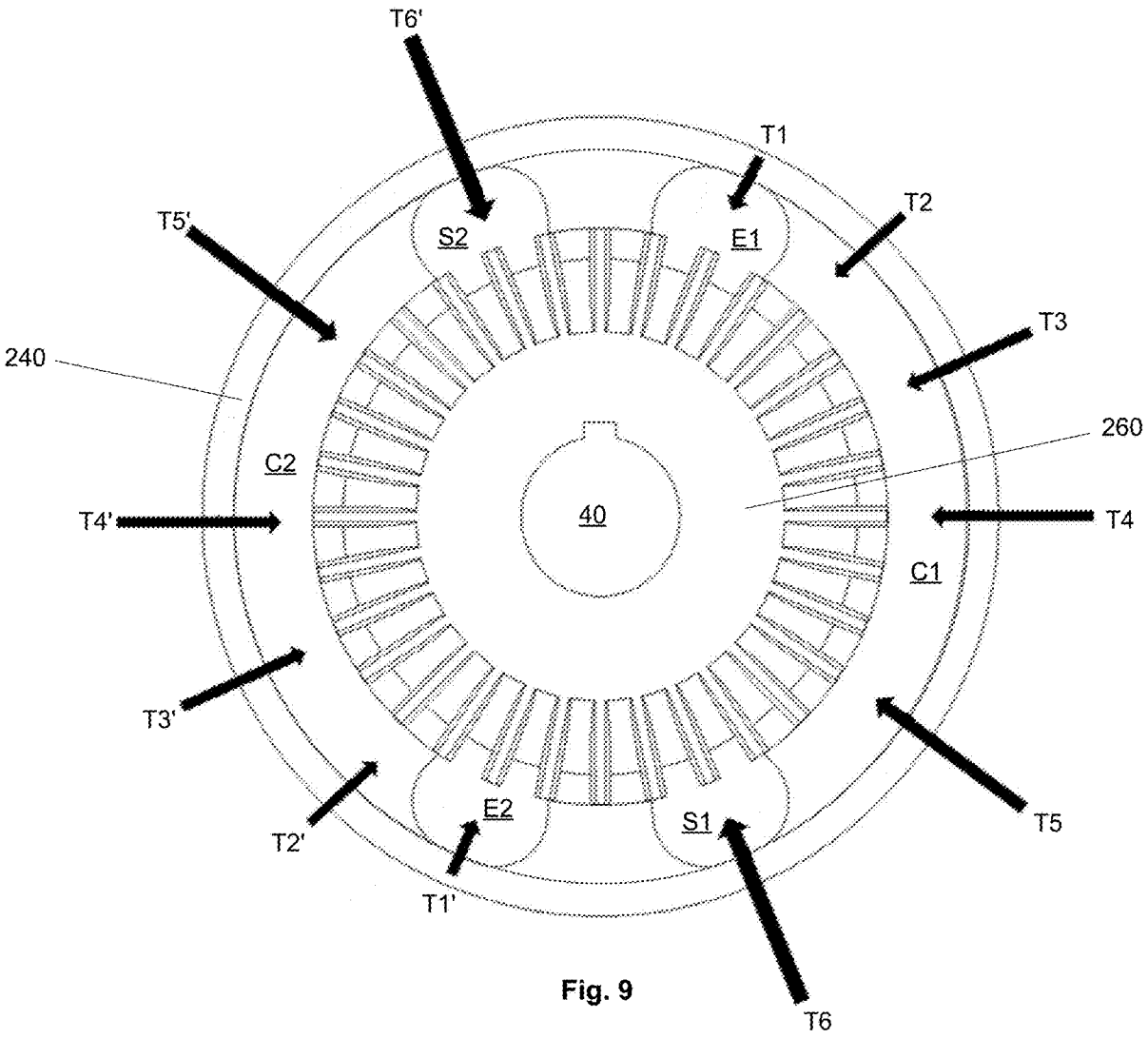
FIG. 9 depicts a top view of a pump stage (24), with the other diffusers (250) hidden.

More specifically, as shown in FIG. 9 for a pump stage (24) with two inlet valves (E1, E2), two circular channels (C1, C2) and two outlet valves (S1, S2), the gradual increase pressure of the fluid (F) between the first inlet (E1) and second outlet (S1) causes a gradual increase in shear stress on the shaft (40), as indicated by arrows "T1" to "T6". Similarly, the gradual increase in pressure of the fluid (F) between the second inlet (E2) and second outlet (S2) causes a gradual rise in shear stress on the shaft (40), as indicated by arrows "T1" to "T6". The fact that the inlet (E1, E2) and outlet stages (S1, S2) are evenly distributed along the internal perimeter of the stator (240) means shear stress "T1" has the same magnitude and the opposite direction to shear stress "T1" so that the result between the two shear stresses "T1" and "T1" is zero. The same is true for the remaining shear stresses "T2" to "T6" in relation to shear stresses "T2" to "T6", where the result of the shear stress acting on the shaft (40) in each pumping stage is zero.

Figure 10:
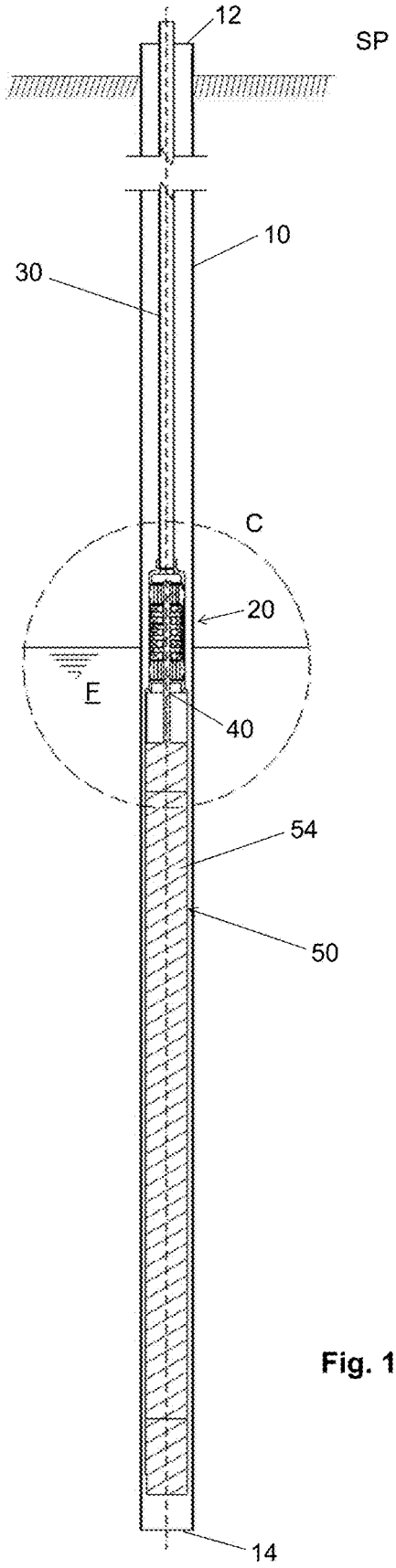
FIG. 10 shows a longitudinal section of a progressive vortex pump according to the invention, installed in a well, with a submersed motor assembly (50).

When the progressive vortex pump is installed in a well, as shown in FIGS. 1 and 10, the pump assembly (20) is positioned inside a casing pipe (10) of the well, with its upper end (12) at the surface of the well (WS) and the lower end (14) in contact with the fluid (F) to be pumped. Similarly, the pump tubing (30) runs inside the well casing pipe (10) to the well surface (WS).

Figure 11:
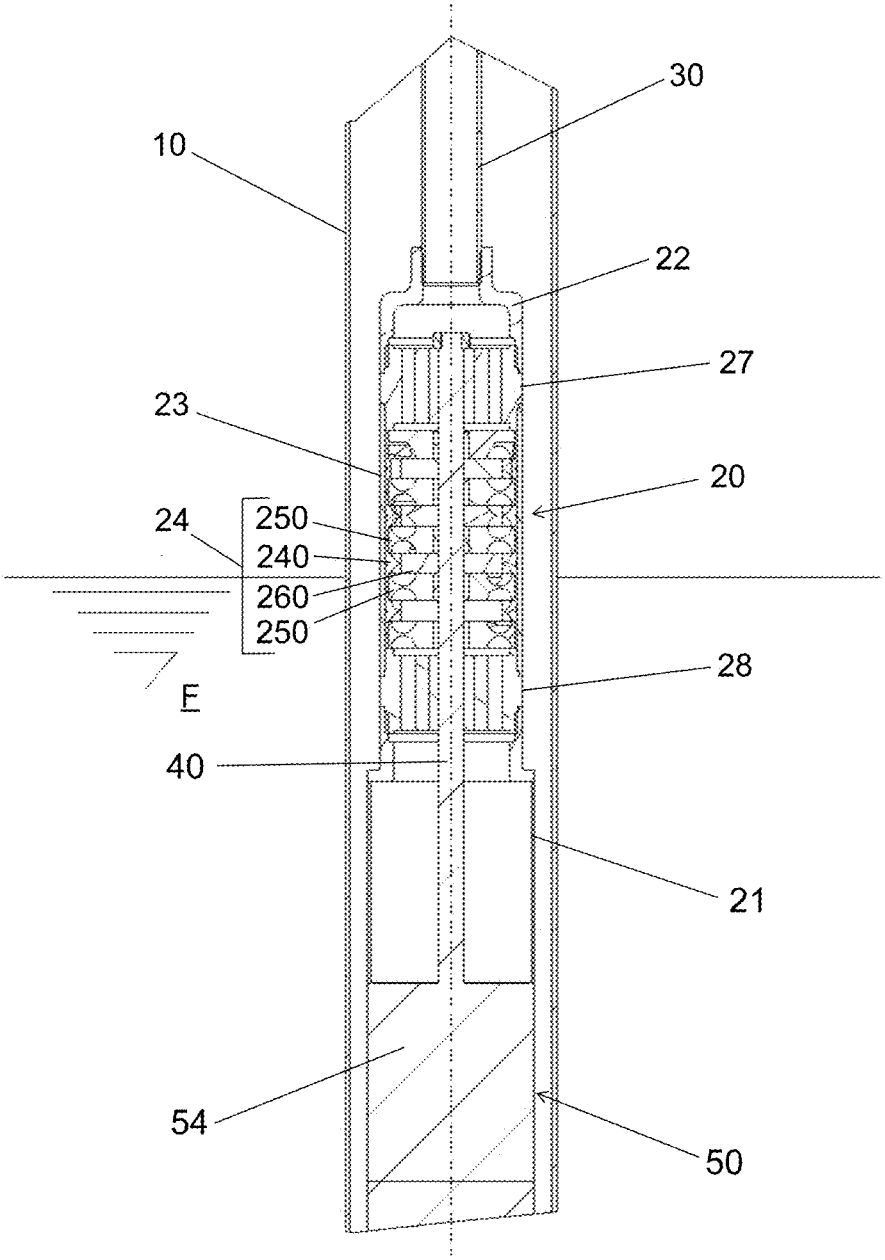
FIG. 11 shows an enlarged view of region "C" indicated in FIG. 10.

In a progressive vortex pump installed in a well with a surface motor assembly (50), the shaft (40) runs from the pump assembly (20) through the pump piping (30) to the motor assembly (50), comprising a surface electric motor (52) positioned at the well surface (WS), as shown in FIG. 1. In a progressive vortex pump installed in a well with a submersed motor assembly (50), the shaft (40) runs from the pump assembly (20) to the motor assembly (50), comprising a submersed electric motor (54) positioned underneath the well surface (WS), as shown in FIGS. 10 and 11.

Figure 2:
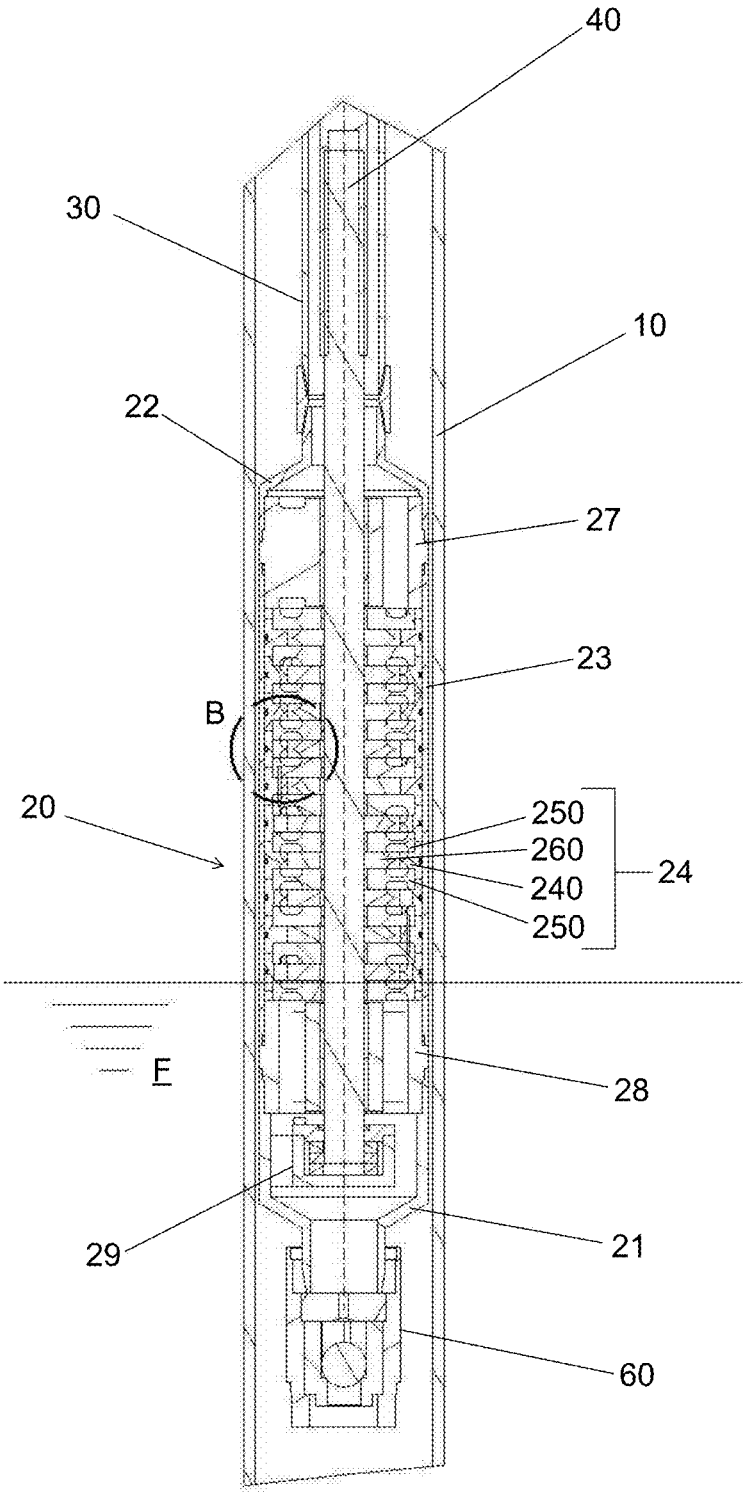
FIG. 2 shows an enlarged view of region "A" indicated in FIG. 1.
Figure 3:
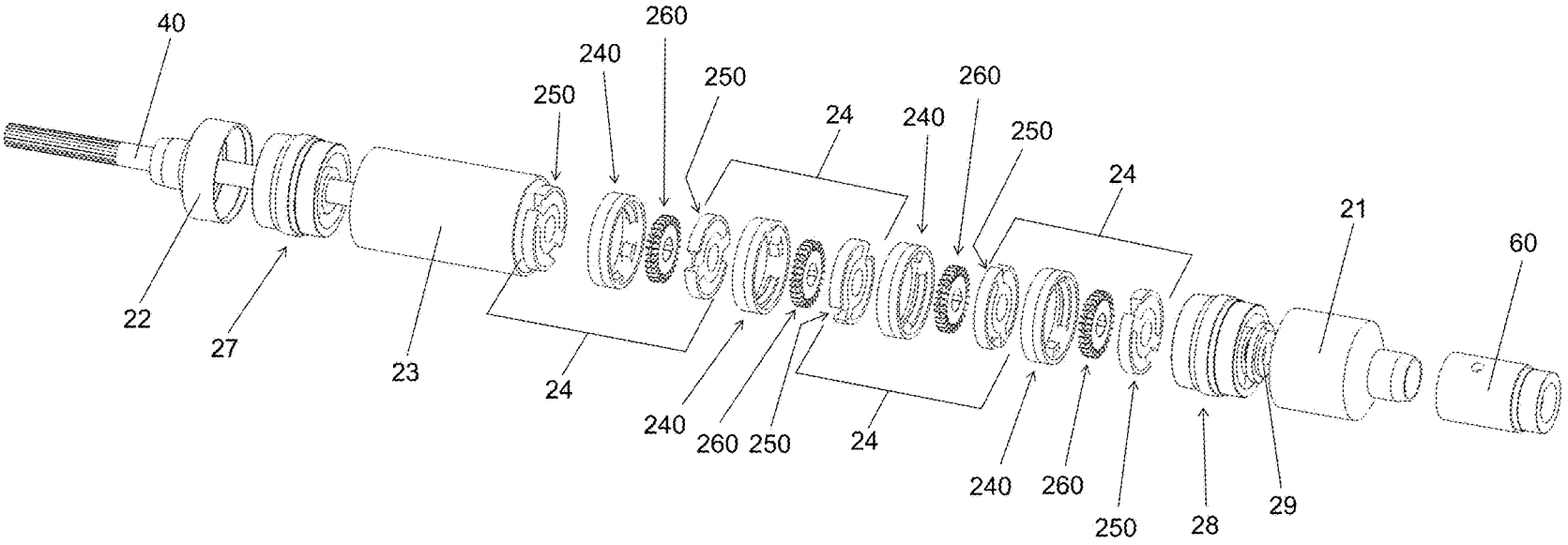
FIG. 3 is an exploded view of a progressive vortex pump, with pump stages (24) configured according to the first incorporation of the invention.

As per FIGS. 2 and 3, the pump assembly (20) also consists of an upper radial bearing (27) located between the outlet valve (22) and the upper outlet stage (24), a lower radial bearing (28) and an axial bearing (29), both situated between the inlet valve (21) and the lower pump stage (24); these bearings (27, 28, 29) are responsible for bushing of the shaft (40). A check valve (60) can also be connected to the inlet (21) of the pump assembly (20) of the progressive vortex pump.

Naturally, the pressure of the fluid (F) pumped increases in accordance with the number of pump stages (24) of the progressive vortex pump. As such, the number of pump stages (24) of a progressive vortex pump is configured according to the desired application. For example, FIG. 2 shows a progressive vortex pump with ten pump stages (24), while FIGS. 3 and 11 depict a progressive vortex pump with four pump stages (24).

The preferred or alternative incorporations described herein do not have the power the limit the present invention to structural forms; equivalent constructive variations are possible, though still within the scope of protection of the invention.

The invention claimed is:

1. A progressive vortex pump, comprising:

a pump assembly having an inlet valve in contact with a fluid to be pumped and an outlet valve in contact with a pump pipe, the pump assembly being driven by a shaft connected to a motor assembly and including a pump body inside which are a variety of pump stages, each pump stage comprises a stator attached to the pump body, a diffuser attached to the front of the stator, another diffuser attached to the rear of the stator, and a rotor coupled to an axis inside the stator, wherein each pump stage comprises at least two inlet stages, each inlet stage is in contact with a respective circular channel, each circular channel is in contact with a respective outlet stage, the inlet stages are evenly distributed along an internal perimeter of the stator, the outlet stages are evenly distributed along the internal perimeter of the stator, the pump stages are arranged such that each outlet stage of a front pump stage is connected to a respective inlet stage of a rear pump stage.

* * * * *